United States Patent [19]

Jackson et al.

[11] Patent Number: 4,860,508

[45] Date of Patent: Aug. 29, 1989

[54] FLOORING SYSTEM AND METHOD FOR CONSTRUCTING SAME

[76] Inventors: Thomas L. A. Jackson, 592 S. Victor Way, Aurora, Colo. 80012; James L. Hamit, 3800 S. Ogden, Englewood, Colo. 80110

[21] Appl. No.: 301,809

[22] Filed: Jan. 24, 1989

[51] Int. Cl.[4] ..... E02D 27/42

[52] U.S. Cl. ..... 52/169.1; 52/480; 405/299

[58] Field of Search ..... 52/169.1, 299, 169.9, 52/480; 405/229, 230

[56] References Cited

U.S. PATENT DOCUMENTS

| | | | |
|---|---|---|---|
| 56,563 | 7/1866 | Huestis | 404/41 |
| 274,449 | 3/1883 | Lee | 52/204 |
| 326,823 | 3/1890 | Bedin . | |
| 446,752 | 2/1891 | Jaquet et al. | 404/46 |
| 661,336 | 11/1900 | Dyarman | 404/41 |
| 2,298,184 | 10/1942 | Von Rosenberg . | |
| 3,300,936 | 1/1967 | Travaglia | 52/169.1 X |
| 3,438,312 | 4/1969 | Becker et al. | 52/177 |
| 3,504,472 | 4/1970 | Clement | 52/477 |
| 3,505,764 | 4/1970 | Guiterrez | 52/263 |
| 3,775,918 | 12/1973 | Johnson | 52/169.1 |
| 3,827,204 | 8/1978 | Walters | 52/396 |
| 3,909,996 | 10/1975 | Ettlinger et al. | 51/177 |
| 4,015,432 | 4/1977 | Ball | 405/229 |
| 4,058,941 | 11/1977 | Zakrzewski et al. | 52/169 |
| 4,508,472 | 4/1985 | Handy et al. | 405/229 |
| 4,516,375 | 5/1985 | Pagano et al. | 52/381 |
| 4,628,645 | 12/1986 | Tafelski, Jr. | 52/169.1 |
| 4,704,052 | 11/1987 | Aubert | 405/229 |

FOREIGN PATENT DOCUMENTS

| | | | |
|---|---|---|---|
| 1928642 | 12/1970 | Fed. Rep. of Germany | 52/480 |
| 512436 | 1/1921 | France | 52/480 |

OTHER PUBLICATIONS

Peck, Ralph B.; Foundation Engineering, 2nd Ed.; Chapter 20.

Kantey, Basil A.; Some Secrets to Building Structures on Expansive Soils Civil Engineering; Dec. 1980.

*Primary Examiner*—Carl D. Friedman

*Attorney, Agent, or Firm*—Gregg I. Anderson

[57] ABSTRACT

A flooring system as disclosed which includes a substructure placed on an earth surface, which supports a floor structure. The substructure is composed of a plurality of longitudinally-extending I-beams interconnected by longitudinally-extending styrofoam blocks. A floor structure is connected to the substructure, the floor structure including flooring pieces having a long side and a short side. The flooring pieces are connected to the substructure so that the long sides extend transversely to the length of the I-beams. In an alternative embodiment, the I-beams include a support and location leg for connecting the styrofoam blocks. According to a method of the invention, the substructure and floor structure are interlocked by the criss-cross pattern described.

8 Claims, 2 Drawing Sheets

FLOORING SYSTEM AND METHOD FOR CONSTRUCTING SAME

BACKGROUND OF THE INVENTION

1. Field of the Invention

The invention relates to flooring systems which contact an earth surface between foundation walls of residential or commercial buildings. More particularly, the flooring system is for installation over the earth surface to provide a foundation on which floor coverings, such as carpet, linoleum, tile and the like are secured.

2. Description of the Prior Art

Where expansive soils are a problem, numerous construction methods have been utilized in order to minimize damage to concrete basement floors resulting from expansion of clay-type soils. Use of support pilings driven to a stable soil level and hollow forms which form a void or expansion area are the principal recognized means for solving this problem. Even these methods fail on occasion, and when such failures occur, an expensive repair job is necessary. At least a portion of the concrete floor must be jackhammered out and removed at considerable expense and inconvenience. No floor has been previously known that can be partially removed to allow the earth surface to be regraded and the floor reinstalled on the regraded surface, re-using most of the original floor material.

Radon gas seeping into homes from soil beneath the foundation has become an increasing problem in certain parts of the country. Over an extended period of time, various health problems are associated with continuous exposure to radon gas. One solution to the problem is to ventilate underneath the foundation of the home where the gas is present and expel the gas outside the living area. With the present invention, such an adaptation is very easily done because the floor system is supported above the earth.

Prior art patents illustrate other ways in which to support a flooring system over a soil structure or earth surface. U.S. Pat. No. 4,058,941, issued to A. Zakrzewski, et al., shows a floor structure supported by a metal support substructure. An interlocking substructure for a patio floor is disclosed in U.S. Pat. No. 3,504,472, issued to A. Clement. In Clement, panels are connected directly to the substructure.

U.S. Pat. No. 3,775,918, issued to A. Johnson, forms a surface of outdoor tiles which interconnect at corners thereof to anchors previously inserted into the ground. U.S. Pat. No. 3,438,312 to J. Becker, et al. shows a flexible and resilient ground covering, but no flooring is attached thereto. An interlocking floor mat is seen in U.S. Pat. No. 3,909,996, issued to R. Ettlinger, Jr., et al.

None of the earth-supported flooring systems is disclosed for use with expansive soil environments, as a solution to the radon gas problem or as a quick and easily-repaired flooring system. Other prior art patents showing various flooring systems include U.S. Pat. Nos. 661,336, issued to G. Dyarman; 56,563, issued to D. Huestis; U.S. patent application Ser. No. 326,823, published June 15, 1943, to J. Bedin; U.S. Pat. Nos. 446,752, issued to J. Jaquet, et al.; and 3,505,764, issued to J. Gutierrez.

Other prior art concerning expansive soil conditions and foundations therefor is seen in *Foundation Engineering,* 2nd Ed., Chapter 20, by Ralph B. Peck, et al.; *Civil Engineering,* a publication of the American Society of Civil Engineers, published December 1980; U.S. Pat. Nos. 4,508,472, issued to R. Handy, et al.; 4,015,432, issued to H. Ball; and 2,298,184, issued to H. Von Rosenberg.

U.S. Pat. No. 3,827,204 to F. Walters shows sectionalized flooring and a method for making such a floor Block or brick modular elements connected together are seen in U.S. Pat. No. 4,516,375 to M. Pagano, et al. A prefabricated roof system is seen in German Pat. No. 1,928,642, while a different building brick is seen in U.S. Pat. No. 274,449, issued to J. Lee.

SUMMARY OF THE INVENTION

It is the principal object of the present invention to provide a flooring system that is supported on an earth surface that is easily constructed from simple components and which can be easily repaired if damage to the floor occurs.

It is another object of the present invention to provide a flooring system in which a floor is supported above an earth surface providing a void space from which contaminant material can be removed and in which expansive soil types can move.

In accordance with the objects of the invention, a flooring system includes a modular substructure which rests on an earth surface and which supports a floor structure and floor thereon. The substructure is comprised of longitudinally-extending I-beam pieces interconnected laterally by styrofoam blocks. The styrofoam blocks are secured to a web and an upper and lower flange of the I-beams by gluing A lower flange of the I-beam rests on the earth surface.

Plywood floor pieces of the floor structure are secured to the upper flange of the I-beams by fastening means, such as screws or the like. A covering is then securable directly to the floor structure, defining a conventional floor The floor pieces are envisioned to extend transverse to the I-beams.

A method of the present invention includes the steps of placing the substructure in position with the I-beams and styrofoam blocks extending in a first direction and the floor pieces extending transversely thereto and connected thereto. The floor is then connected to the floor pieces of the flooring structure.

Other aspects, features and details of the present invention can be more completely understood by reference to the following detailed description of the preferred embodiment, taken in conjunction with the drawings and from the appended claims.

DESCRIPTION OF THE PREFERRED EMBODIMENT

Figure 1:
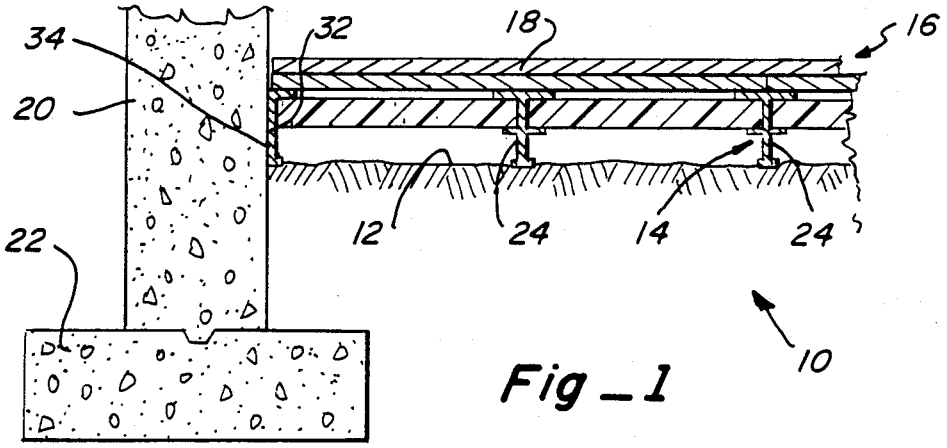
FIG. 1 is a sectional view of a flooring system of the present invention installed adjacent to a foundation wall and on an earth surface.
Figure 2:
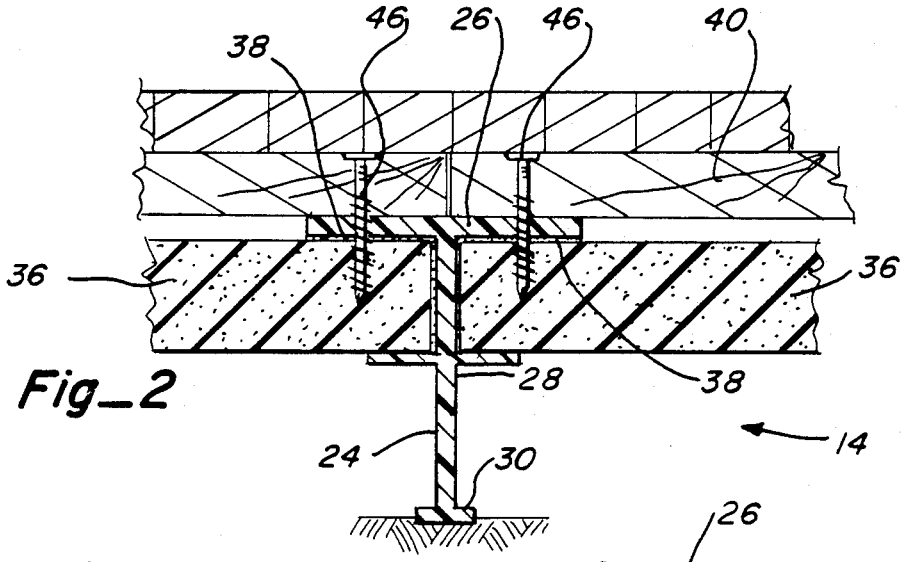
FIG. 2 is a fragmentary enlarged sectional view of the flooring system shown in FIG. 1.

As seen in FIG. 1, a flooring system 10 rests on an underlying earth surface 12. The flooring system 10 includes a substructure 14 which rests on the earth surface 12 and a floor structure 16, which floor structure 16 is supported by and connected to the substructure 14. In turn, a floor 18, such as linoleum, tile or carpet or the like, is connected to the floor structure 16 in any conventional manner. (FIG. 2). The flooring system 10 extends between foundation walls 20, which walls are supported by a foundation 22. (FIGS. 1 and 4).

The substructure 14 is made up of a plurality of longitudinally-extending I-beams 24. Each of the I-beams 24 includes an upper flange 26, a web 28, and a bottom flange 30. The I-beams 24 are of any length, but eight foot lengths are preferred. The height of the I-beams 24 is preferably three inches, the upper flange 26 being two inches wide and the bottom flange 30 being three-quarters inch wide. The I-beams 24 are made of high strength and density plastic, which is available commercially, such as a polyvinyl chloride.

As seen in FIG. 1, at the point where the I-beam 24 abuts the foundation wall 20, the upper flange 26 and bottom flange 30 can be removed so that a modified I-beam 32 is connected to the foundation wall 20, by any conventional fastening means, through a web 34 of the modified I-beam 32.

Figure 3:
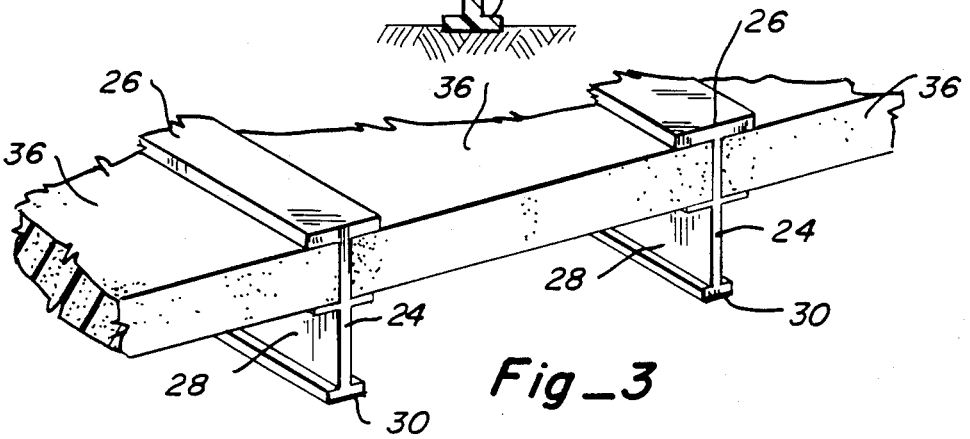
FIG. 3 is a perspective view of the flooring system shown in FIG. 1.
Figure 4:
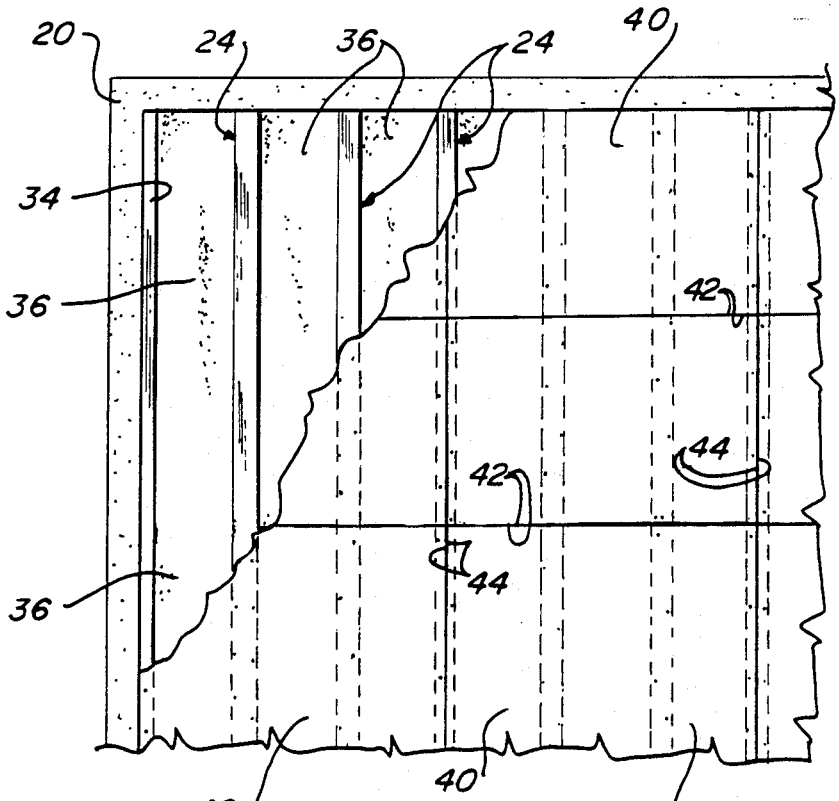
FIG. 4 is a top plan view of the flooring system shown in FIG. 1.

As seen in FIGS. 1, 3 and 4, styrofoam, or other low density plastic, blocks 36 are connected between parallelly-extending I-beams 24. Glue 38 is used to connect the styrofoam blocks 36 to the web 28 and underneath the upper flange 26 of adjacent, parallelly-extending I-beams 24. The styrofoam blocks 36 are also of eight foot length. In cross-section, the styrofoam blocks 36 are sixteen inches wide and one and one-half inches deep.

In accomplishing the method of the invention, the substructure 14 is placed over the earth surface 12 until the entire earth surface 12 is covered It will be necessary to abut the I-beams 24 and connected styrofoam blocks 36 in order to cover the entire area. The longitudinal abutment between the I-beams 24 and the styrofoam blocks 36 does not require connection between the I-beams 24 or the styrofoam blocks 36, though a connection between longitudinally adjacent I-beams 24 may be desirable in certain instances. Such a connection could be by any conventional means, including stapling adjacent I-beams 24.

Once the substructure 14 has been laid out as described above, the floor structure 16 is attached. As seen in FIGS. 2 and 4, the floor structure 16 includes floor pieces 40 of rectangular plan view and having a long side 42 and short side 44. Such floor pieces 40 are preferrably eight feet long on the long side 42 and four feet wide on the short side 44, as one might buy conventional plywood, which could be used for the floor structure 16. The floor pieces 40 are connected by screws, nails or other fastening means 46 to the upper flange 26 of the I-beams 24. The floor pieces 40 are arranged so that the long side 42 is transverse to the length of the I-beams 24. (FIG. 4). This connection pattern interlocks the substructure 14 to the floor structure 16. The conventional floor 18 is then secured to the floor structure 16 in any known manner.

Figure 5:
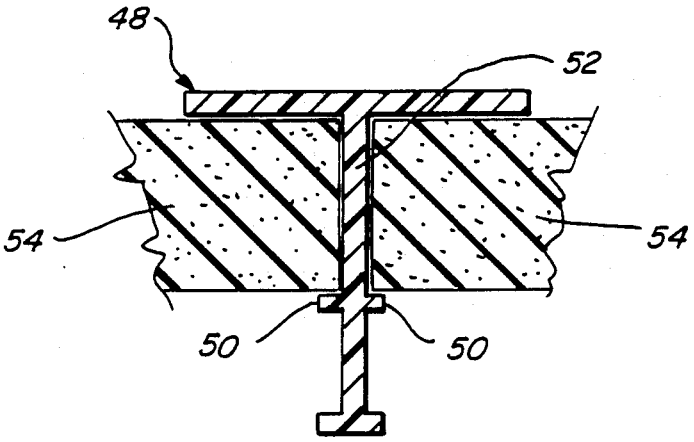
FIG. 5 is an elevational view of a modified I-beam of the flooring system.

In an alternative embodiment of the I-beam 48 (FIG. 5), an integral support flange or leg 50 is formed on the web 52 to support and locate a styrofoam block 54. This modified I-beam 48 is somewhat easier to use in the flooring system 10 because of the location and support features given by the support leg 50.

The flooring system 10 is ideally assembled with the styrofoam block 36 already attached to the I-beam 24. In this manner, I-beam block combinations are easily and quickly connected together to form the substructure 14. The floor structure 16 is then easily connected thereto by simple fastening means.

Although the invention has been described with a certain degree of particularity, the full scope of the invention is seen in the appended claims and their equivalents.

We claim:

1. A flooring system for placement on an earth surface comprising in combination:

a substructure formed by joining together a plurality of longitudinally-extending I-beams having an upper flange, a bottom flange and an integrally-connecting web, said I-beams transversely connected by longitudinally extending blocks connected to the web and upper flange of said I-beams by glue, the bottom flange of said I-beams setting on the earth surface;

a floor structure connected to the upper flange of said I-beams by fastening means; and a floor connected to said floor structure.

2. The invention as defined in claim 1 wherein said floor structure further includes flat, rectangular plywood pieces having a long side and a short side, the floor structure mounted to the substructure transverse to the length of the I-beams.

3. The invention as defined in claim 1 wherein the blocks are connected to the I-beams by upper and lower flanges with glue.

4. The invention as defined in claim 1 wherein the floor structure is connected to the substructure by screws.

5. The invention as defined in claim 1 wherein the I-beams and blocks are selectively connected together in eight-foot lengths.

6. The invention as defined in claim 5 wherein the I-beams are separated by the blocks on sixteen-inch centers.

7. The invention as defined in claim 1 wherein said I-beams include a support flange extending perpendicularly from the web for supporting and locating the blocks.

8. The invention as defined in claim 1 wherein said blocks are made of low density plastic.

* * * * *